US012595734B2

(12) United States Patent
Wehrmeyer et al.

(10) Patent No.: US 12,595,734 B2
(45) Date of Patent: Apr. 7, 2026

(54) CUTTING WHEEL FOR A CUTTING BORING MACHINE

(71) Applicant: HERRENKNECHT AKTIENGESELLSCHAFT, Schwanau (DE)

(72) Inventors: Gerhard Wehrmeyer, Schwanau (DE); Jens Brandt, Bad Krozingen (DE)

(73) Assignee: HERRENKNECHT AKTIENGESELLSCHAFT, Schwanau (DE)

( * ) Notice: Subject to any disclaimer, the term of this patent is extended or adjusted under 35 U.S.C. 154(b) by 319 days.

(21) Appl. No.: 18/279,731

(22) PCT Filed: Apr. 14, 2022

(86) PCT No.: PCT/EP2022/060017
§ 371 (c)(1),
(2) Date: Aug. 31, 2023

(87) PCT Pub. No.: WO2022/228904
PCT Pub. Date: Nov. 3, 2022

(65) Prior Publication Data

US 2024/0151142 A1 May 9, 2024

(30) Foreign Application Priority Data

Apr. 28, 2021 (DE) ..... 10 2021 110 855.1

(51) Int. Cl.
*E21D 9/00* (2006.01)
*E21D 9/087* (2006.01)

(52) U.S. Cl.
CPC ..... *E21D 9/003* (2013.01); *E21D 9/087* (2013.01)

(58) Field of Classification Search
CPC ..... E21D 9/003; E21D 9/087
See application file for complete search history.

(56) References Cited

U.S. PATENT DOCUMENTS 4,744,241 A 5/1988 Mayer
5,030,920 A 7/1991 Nakamura
(Continued)

FOREIGN PATENT DOCUMENTS

CN 105486216 A 4/2016
CN 105973896 A 9/2016
(Continued)

*Primary Examiner* — Janine M Kreck
(74) *Attorney, Agent, or Firm* — Tucker Ellis LLP

(57) ABSTRACT

In a cutting wheel (103) for a tunnel boring machine, a tool condition monitoring device is provided to monitor the condition of at least one mining tool (112, 115, 118) during removal of a geological structure present, during tunneling, at the cutting wheel (103) in a tunneling direction. At least one support part (121, 124, 127) is installed separately and at a distance from the or a relevant mining tool (112, 115, 118). In the relevant support part (121, 124, 127), a current conductor element is embedded, which is interrupted in terms of its ability to carry current after a wear limit which is characteristic of the condition of the relevant mining tool (112, 115, 118) has been reached. In this way, the condition of mining tools (112, 115, 118) can be reliably determined during a relatively simple maintenance operation or retrofitting with a support part (121, 124, 127).

17 Claims, 9 Drawing Sheets

(56) References Cited

U.S. PATENT DOCUMENTS

| | | | | |
|---|---|---|---|---|
| 5,438,860 | A * | 8/1995 | Kawai | G01N 3/58 451/6 |
| 2011/0031017 | A1 | 2/2011 | Iwata et al. | |
| 2021/0180452 | A1 | 6/2021 | Weiser | |
| 2022/0145757 | A1 | 5/2022 | Himmelsbach | |

FOREIGN PATENT DOCUMENTS

| | | | | |
|---|---|---|---|---|
| CN | 108776074 | A | 11/2018 | |
| DE | 102106121466 | A1 | 5/2018 | |
| JP | H0653696 | U * | 7/1994 | G01N 3/58 |
| JP | 2000204884 | A | 7/2000 | |

* cited by examiner

CUTTING WHEEL FOR A CUTTING BORING MACHINE

RELATED APPLICATIONS

This application claims the benefit of International Application No. PCT/EP2022/060017, Apr. 14, 2022 and German Application No. 102021110855.1, filed Apr. 28, 2021, the entirety of which are incorporated by reference herein.

TECHNICAL FIELD

The invention relates to a cutting wheel for a tunnel boring machine.

BACKGROUND

One example existing cutting wheel for a tunnel boring machine is known from US 2011/0031017 A1. This previously known cutting wheel is provided with a number of mining tools for removing geological structures present at the cutting wheel during tunneling in a tunneling direction and has a tool condition monitoring device for monitoring the state of wear of mining tools. The tool condition monitoring device has a number of support parts associated to a mining tool or a group of mining tools, which are spatially distanced from the or a mining tool or from the or a group of mining tools and which are removably connected to a frame structure of the cutting wheel. A number of electrically conductive current-conductor elements is embedded in the or each support part, which support parts end in abrasion probes protruding beyond the support part and through which the abrasion level of protruding abrasion probes can be detected by resistive measurement.

A mining tool for a cutting wheel of a tunnel boring machine is known from JP 2000 204884 A, in which tool a number of current-conductor elements of different length is embedded, in order to detect the abrasion level of the cutting tool.

A cutting wheel is known from CN 108 776 074 A, which cutting wheel is provided with a number of mining tools for removing geological structures present at the cutting wheel during tunneling in a tunneling direction, and which is provided with a tool condition monitoring device for monitoring the state of wear of mining tools. The tool condition monitoring device on this cutting wheel includes a number of resistive abrasion sensors integrated into the mining tools.

DE 35 35 474 A1 discloses a device for detecting limit wear and/or cutting edge fracture in tools, in which two conductor tracks are integrated into the tool, one conductor track being part of a closed circuit, while the other conductor track is part of a open circuit forms. If, at a certain wear limit of a tool, either the conductor provided in a closed circuit is interrupted or the open circuit is closed by forming a conductive connection between the two conductors, a signal is generated which leads to the termination of a work process.

SUMMARY OF THE INVENTION

The object of the invention is to provide a cutting wheel of the type mentioned above, which is characterized by a reliable, easily adaptable as well as replaceable tool condition monitoring device that can be retrofitted relatively easily to existing designs.

Due to the fact that, according to the invention, the tool condition monitoring device has a support part that is separate from the mining tool or each mining tool to be monitored and in which an electrically conductive current-conductor element is embedded, which is also provided for interruption, on one hand, the wear of mining tools can be monitored through the wear of the support part, which is related to the wear of the mining tool or mining tools by corresponding arrangement of the support part, wherein, due to the configuration of the support part, an easy adaptability to the respective installation situation and to the wear behavior of the tool or of the group of tools can be provided. Moreover, as a separate component from the tool or group of tools, the support part can be retrofitted to existing designs relatively easily without the need for fundamental modification of mining tools.

BRIEF DESCRIPTION OF THE DRAWINGS

Further advantageous embodiments and advantages of the invention result from the following description of exemplary embodiments with reference to the figures of the drawing.

In the figures.

DETAILED DESCRIPTION

Figure 1:
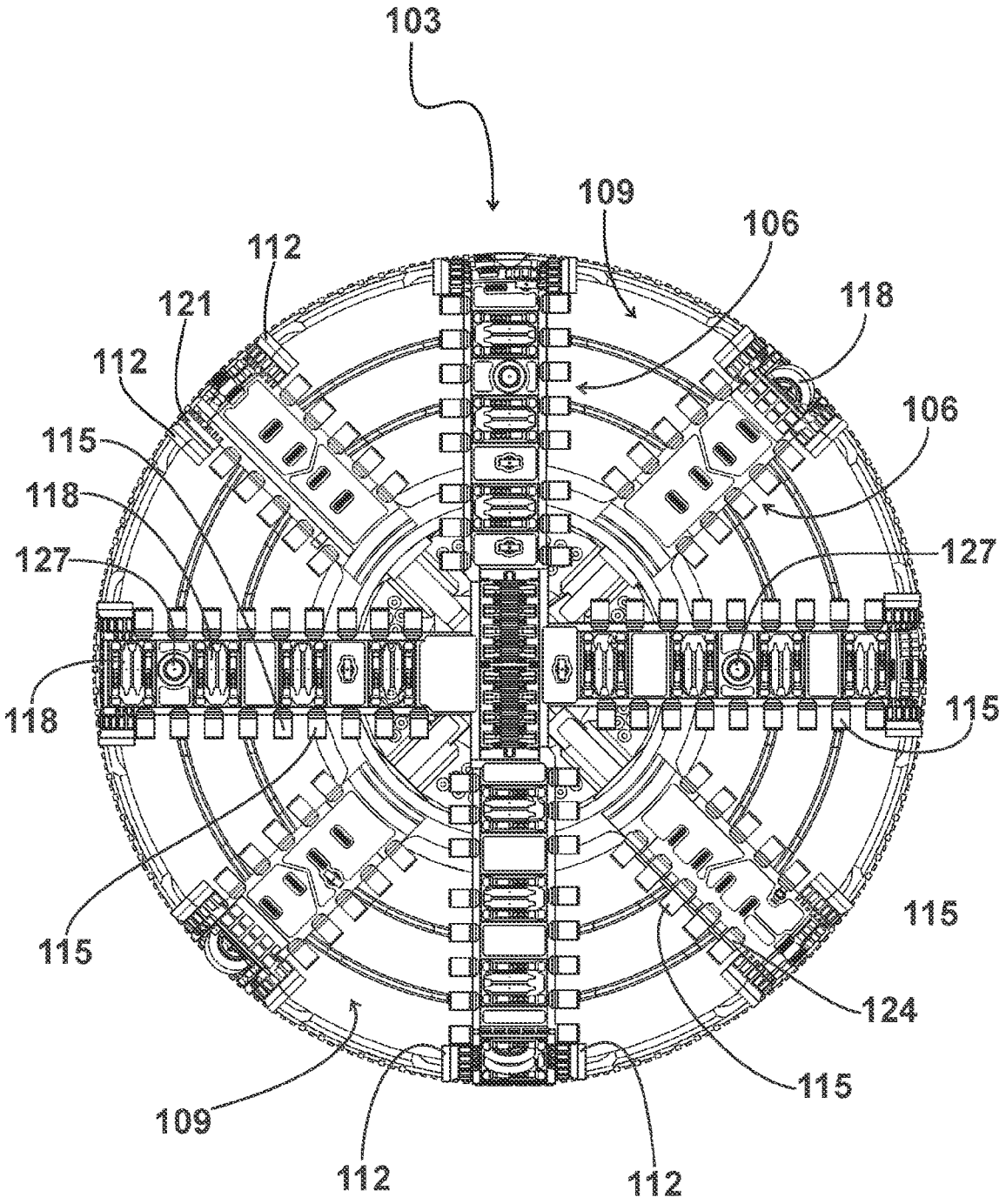
FIG. 1 shows a front view of an exemplary embodiment of a cutting wheel according to the invention, which is provided with a tool condition monitoring device.

FIG. 1 shows a front view of a cutting wheel 103 for a tunnel boring machine with a view of the front side facing the existing geology in the front during a tunneling in a tunneling direction. The cutting wheel 103 according to FIG. 1 has a number of cutting arms 106 which extend radially outwards in the manner of spokes from a central region to an outer circumference of the cutting wheel 103. A number of clearing inlet openings 109 are formed between the cutting arms 106, via which openings the material mined from the existing geology can be conveyed away against the tunneling direction.

In the illustrated embodiment, the cutting arms 106 are provided with a number and different types of mining tools for removing existing geology. The types of mining tools used in the cutting wheel 103 according to FIG. 1 include rakers 112 arranged radially on the outside, scraper knives 115 and cutting rollers 118 arranged between the rakers 112 and the central region. The rakers 112 and scraper knives 115 are arranged on both sides on the cutting arms 106 in the circumferential direction and project beyond them, while the cutting rollers 118 are installed in the central region of the cutting arms 106 in the circumferential direction.

As explained in more detail below, the cutting wheel 103 according to FIG. 1 is provided with a tool condition monitoring device for monitoring the state of wear of a mining tool or a group of mining tools, here in the form of individual rakers 112, groups of several scraper knives 115 and pairs of cutting rollers 118, which, in this exemplary embodiment, has a number of support parts associated with the individual mining tools or groups of mining tools. The support parts are structurally separate from individual mining tools or groups of mining tools and are spatially spaced apart and removably connected to the cutting arms 106 as part of a frame structure of the cutting wheel 103.

In the exemplary embodiment according to FIG. 1, the support parts are designed as intermediate plates 121, each assigned to a raker 112, as one type of intermediate part, intermediate bars 124, each assigned to a group of scraper knives 115, as a further type of intermediate part, and support bolts 127 arranged between two cutting rollers 118.

Figure 2:
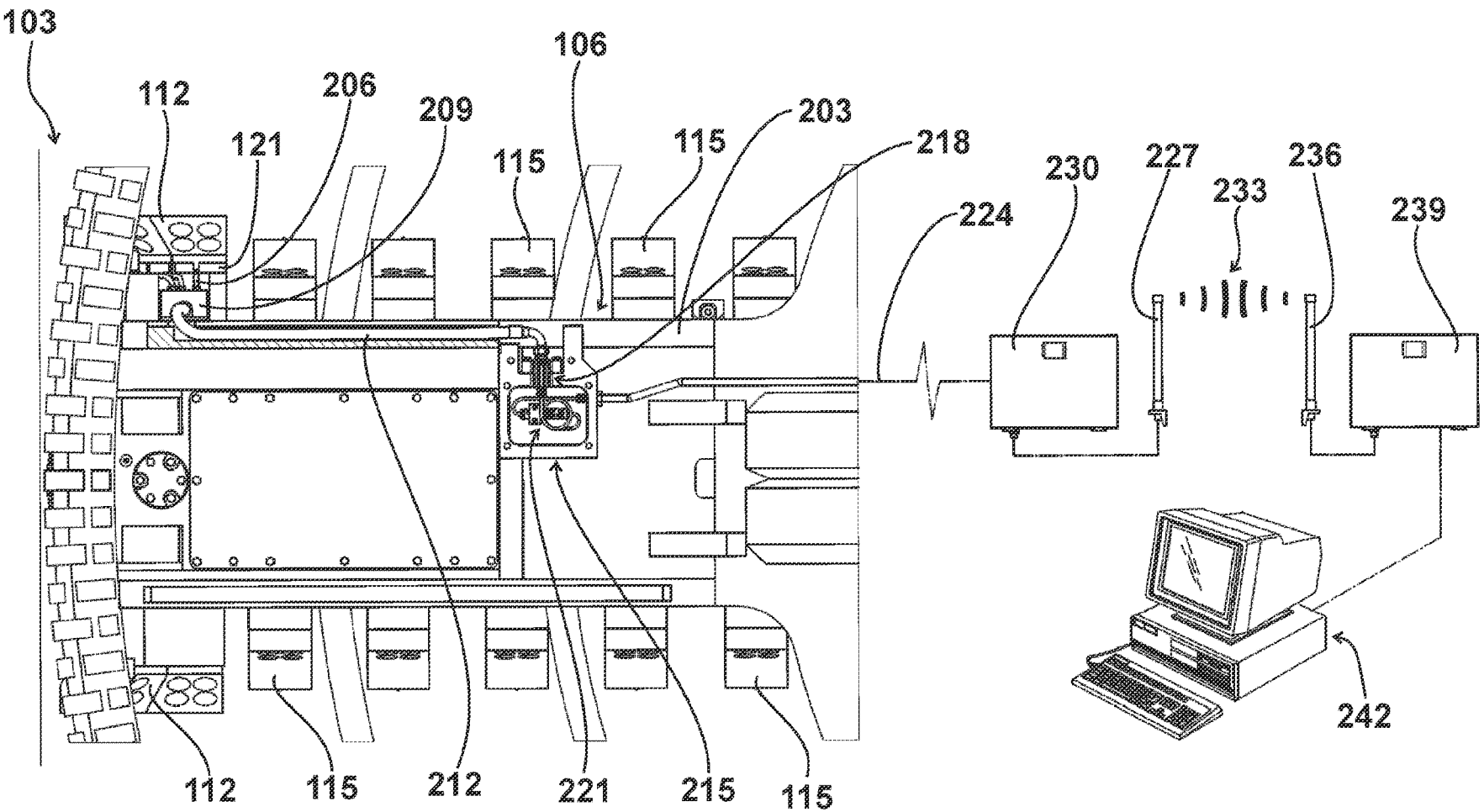
FIG. 2 shows a schematic rear view of an exemplary embodiment of a cutting wheel according to the invention with details of a tool condition monitoring device.

FIG. 2 shows, in a schematic rear view, a detail of the cutting wheel 103 in the region of a cutting arm 106 and further components of the tool condition monitoring device according to the explained exemplary embodiment. From the illustration according to FIG. 2 it can be seen that the rakers 112 arranged radially on the outside are connected to a frame structure 203 of the respective cutting arm 106 via an intermediate plate 121. The intermediate plate 121 is connected via three pipe connections 206, in FIG. 2 shown in an exposed manner, of the tool condition monitoring device, with a line connection box 209 of the tool condition monitoring device, which, in turn, is connected, through a line tube 212 of the tool condition monitoring device, with an interconnection box 215 of the tool condition monitoring device. The connection between the line tube 212 and the interconnection box 215, which is shown open with a removed closing cover in the illustration according to FIG. 2, is provided by a cable entry 218, which is hermetically sealed against dust and humidity A detachable plug connection 221 of the tool condition monitoring device is arranged in the interconnection box 215.

The or each interconnection box 215 is in turn connected via an encapsulated cable harness 224 of the tool condition monitoring device to a transmitting unit 230 of the tool condition monitoring device, which has a transmitting antenna 227, by means of which signals from the tool condition monitoring device can be fed wirelessly via a radio link 233 to a receiving unit 239 of the tool condition monitoring device, which is provided with a receiving antenna 236. The receiving unit 239 is in turn connected wirelessly or by cable to a data processing unit 242 of the tool condition monitoring device, with which the signals from the tool condition monitoring device and thus the wear condition of the monitored mining tools 112, 115, 118 can be monitored.

Figure 3:
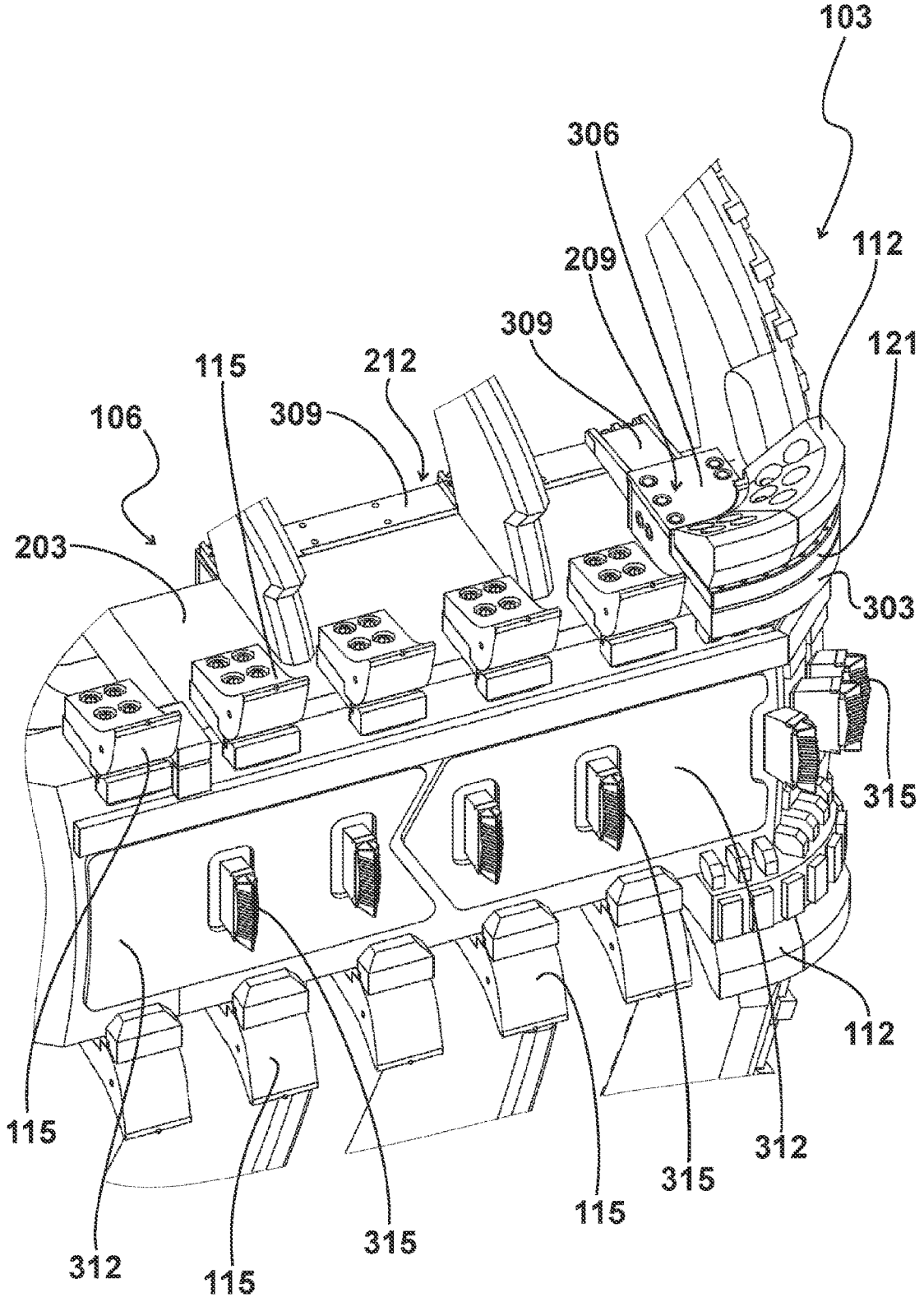
FIG. 3 shows a perspective view of a detail of the cutting wheel according to FIG. 1 in the region of a radially outer raker as an example of a mining too.

FIG. 3 shows a perspective view of a detail of the radially outer edge region of a cutting arm 106 of the cutting wheel 103 shown in FIG. 1. The representation according to FIG. 3 shows that the radially outer raker 112, here designed in multiple parts, are inclined in a direction of rotation of the cutting wheel 103 and arranged in the form of an arc of a circle, for example over a circular arc segment of approximately 90 degrees, and are connected via the intermediate plate 121 to the frame structure 203 of the cutting arm 106. In the exemplary embodiment shown in FIG. 3, a base plate 303 welded to the frame structure 203 is also arranged between the intermediate plate 121 and the frame structure 203, which base plate houses the line connection box 209, which is arranged beneath a base plate cover 306 in the representation of FIG. 3.

The line tube 212 explained with reference to FIG. 2 is arranged in a tube channel 309 of the tool condition monitoring device to protect against external influences, which channel is attached to the rear of the cutting arm 106 in the mining direction.

Furthermore, FIG. 3 shows a number of placement gravers 315, which protrude in the tunneling direction and are arranged approximately centrally on the front side of cutting arm 106 in recesses of wear protection plates 312 or are arranged in the radially outer edge region, as a further type of mining tool, the condition of wear of which is not monitored in this exemplary embodiment.

Figure 4:
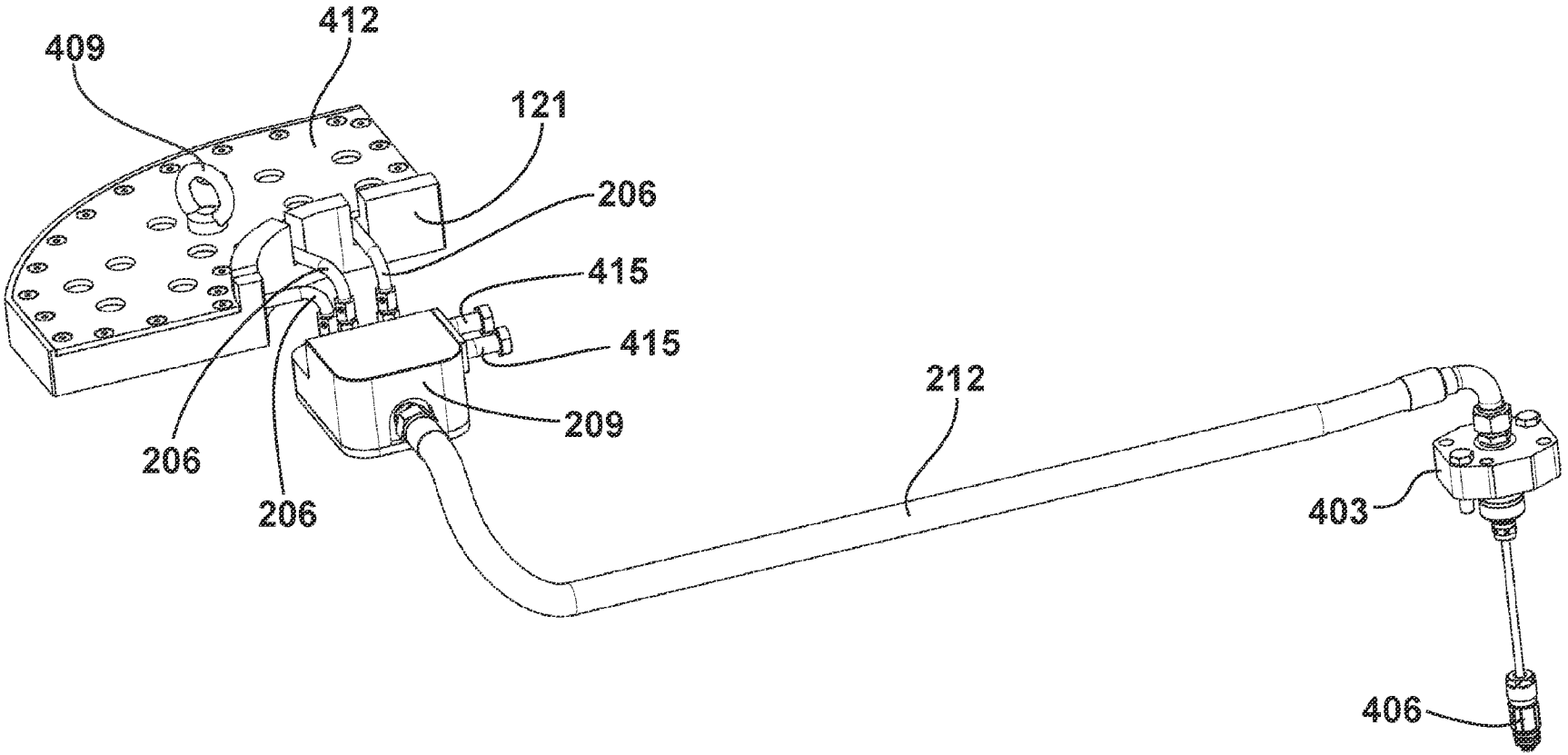
FIG. 4 shows a perspective view of an exemplary embodiment of a raker monitoring module of a tool condition monitoring device.

FIG. 4 shows a perspective view of the arrangement, which is structurally connected to one another as a unit forming a raker monitoring module, consisting of the intermediate plate 121, the pipe connections 206, the line connection box 209, the line tube 212, a connecting flange piece 403 for mechanically connecting the line tube 212 to interconnection box 215, not shown in FIG. 4, and with a plug connection 406 of the tool condition monitoring device for electrical connection to the plug connection 221, not shown in FIG. 4. Furthermore, FIG. 4 shows an eyebolt 409 connected to the intermediate plate 121, which eyebolt is used for handling the structural unit having the intermediate plate 121 and in particular for its easy positioning. The intermediate plate 121 is closed with a screwed intermediate plate cover 412 on the side facing the corresponding raker 112, when installed as intended. Also shown in FIG. 4 are mounting screws 415 which engage with the line connection box 209 and serve to fasten the line connection box 209 to the frame structure 203.

Figure 5:
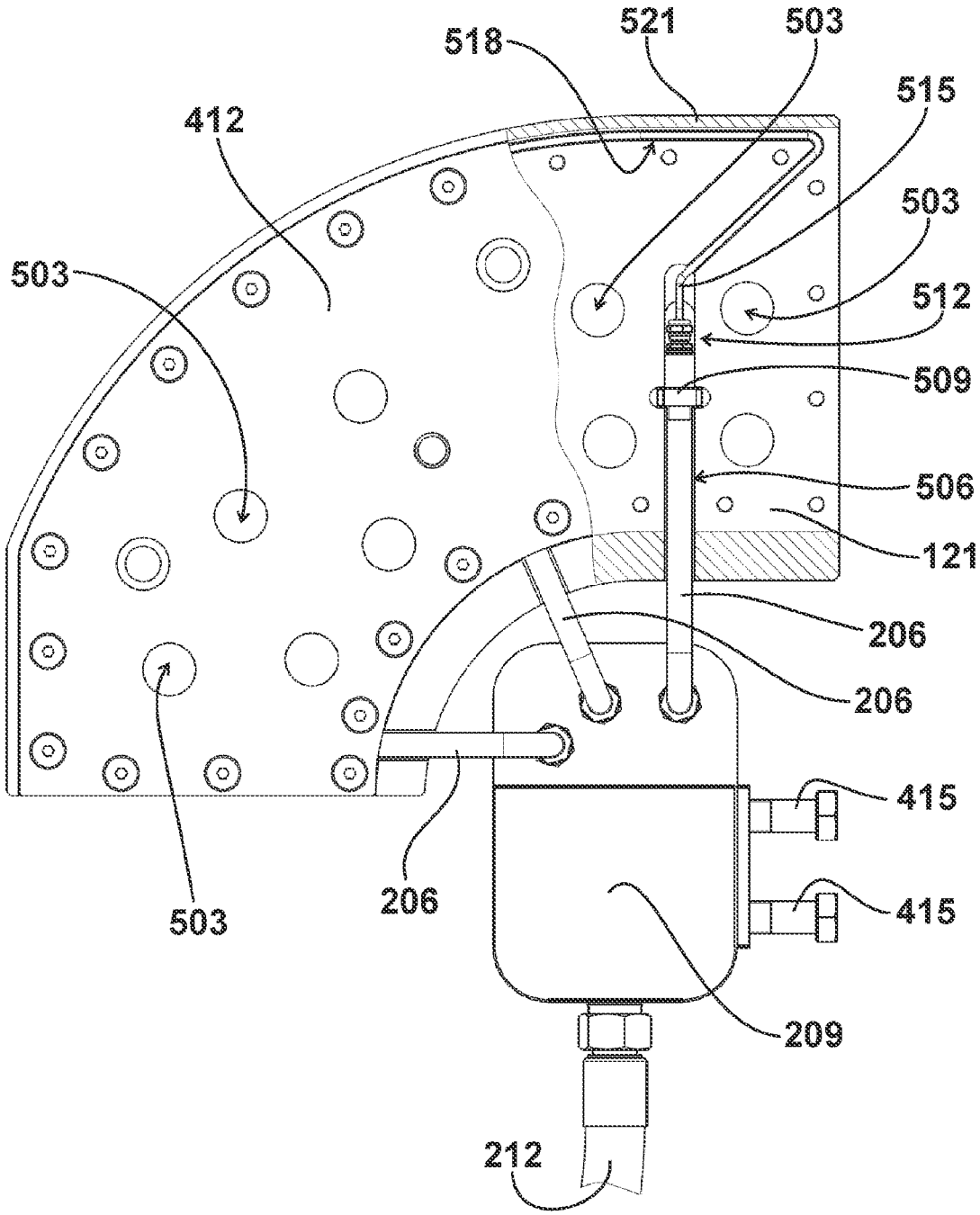
FIG. 5 shows a plan view the raker monitoring module according to FIG. 4.

FIG. 5 shows a plan view of the arrangement according to FIG. 4 in the region of the intermediate plate 121 with an intermediate plate cover 412 in partial front elevation in the region of a pipe connection 206. From FIG. 5 it can be seen that both the intermediate plate 121 and the intermediate plate cover 412 have a number of through-holes 503, through which fastening screws, not shown in FIG. 5, pass through, for connecting the raker 112 to the base plate 303, which is welded to the frame structure 203 and is provided with screw threads assigned to the through-holes 503. Furthermore, it can be seen from the representation according to FIG. 5 that each pipe connection 206 is arranged in a pipe connection groove 506 and ends with a threaded clamping piece 509 and with a cable gland 512 on the side facing away from the line connection box 209.

It can be seen from FIG. 5 that in the cable gland 512 shown, a circuit cable 515 is arranged as an electrically conductive current conductor element of the tool condition monitoring device, which element is electrically insulated to the outside and is arranged in a cable groove 518 formed in the intermediate plate 121 as a cable receiving recess. The cable groove 518 extends from the end of the pipe connection groove 506 in the direction of the front region of the intermediate plate 121 in the tunneling direction and extends in the tunneling direction on the rear of an outer material wall 521 of the intermediate plate 121 along a contour that is geometrically similar to the front of the raker 112, but which is rearwardly offset relative to the front of still unused rakers 112 against the mining direction.

The pairs of circuit cables 515 in the pipe connections 206 are connected to a voltage source (not shown in FIG. 5) of the tool condition monitoring device and, during typical operation of the cutting wheel 103 to mine an existing geology, an electric current flows through them. As soon as the outer material wall 521 has been removed at least in some regions due to the resulting wear of the rakers 112 as an example of mining tools, at least one circuit cable 515 is usually immediately destroyed with an at least temporary interruption of the electrical current flowing there through. Such interruptions in current flow thus indicate that a wear limit value that directly correlates with the state of wear of the corresponding raker 112 has been reached.

This wear limit value can be determined relatively easily based on the installation position of the intermediate plate 121 in relation to the raker 112 and on the position of the cable groove 518 at its distance from the front side of the intermediate plate 121, which is normally positioned at the front in the tunneling direction. Furthermore, when the lower wear limit value of the rakers 112 is reached, which requires the replacement of the rakers 112, the worn and thus unusable intermediate plate 121 of a raker monitoring module can be replaced, as a structural unit together with the worn rakers 112 with a new raker monitoring module according to FIG. 4 with a new intermediate plate 121 with new circuit cables 515 by only loosening screws and plug connections and screwing them back in or putting them together again.

Figure 6:
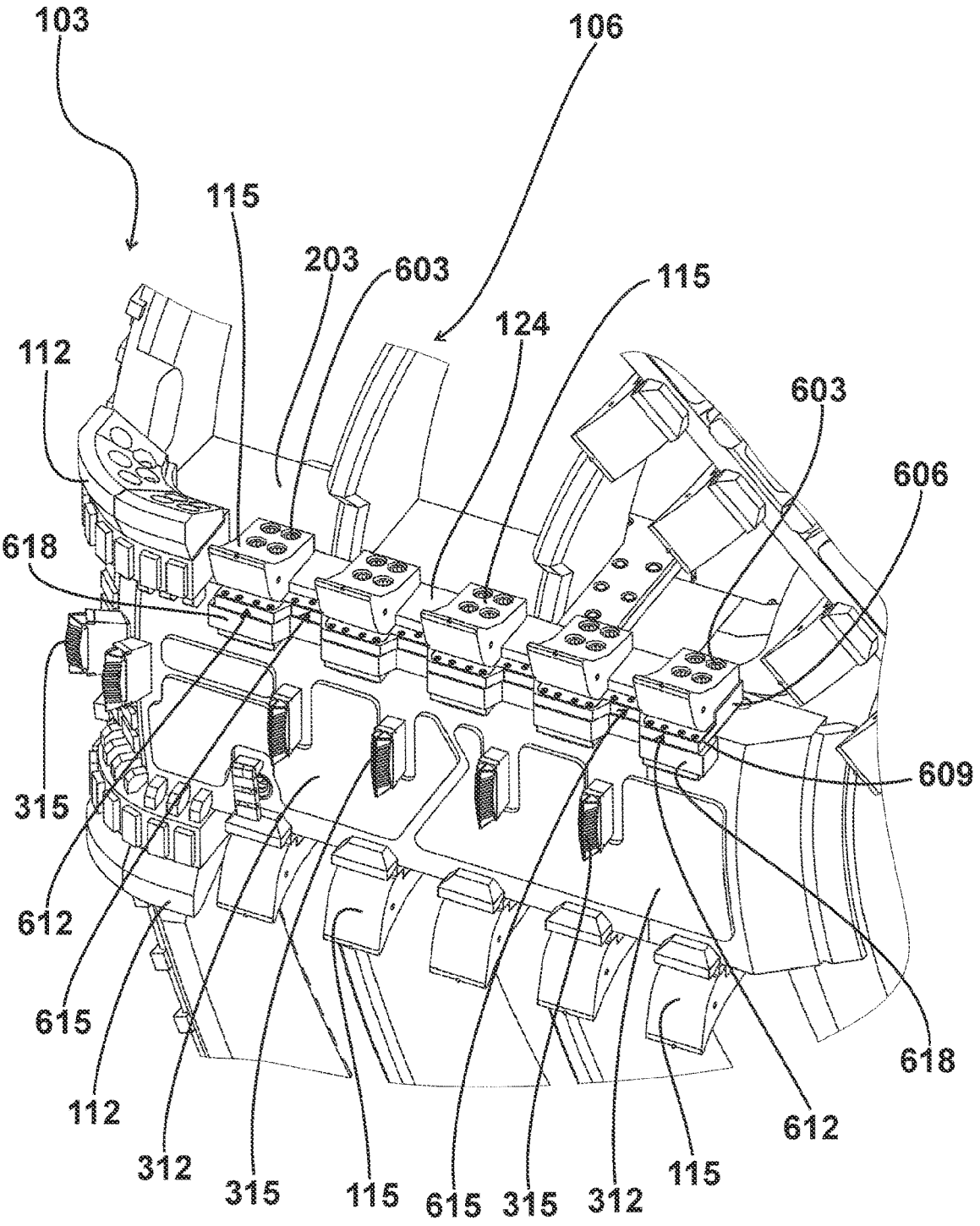
FIG. 6 shows a perspective view of a detail from the exemplary embodiment of a cutting wheel according to FIG. 1 in the region of scraper knives as an example of a group of mining tools in a view to the front side arranged frontally in the tunneling direction.

FIG. 6 shows a perspective view looking towards the front side in the tunneling direction of a region of a cutting arm 106 of the cutting wheel 103 according to FIG. 1. FIG. 6 shows a number of scraper knives 115 represented as a group of mining tools, which are connected to the frame structure 203 of the cutting arm 106 by means of scraper knives fastening screws 603 via a common intermediate bar 124 extending in the radial direction of the cutting arm 106. The intermediate bar 124 is formed in two stages with a thicker base portion 606 arranged at the rear in the tunneling direction and with an abrasion portion 609 arranged at the front in the tunneling direction which is less thick than the base portion 606.

The base portion 606 extends continuously in the longitudinal direction of the intermediate bar 124 with a rectangular cross-section, while the abrasion portion 609 follows a contour that is set back against the tunneling direction compared to the scraper knives 115 attached to the intermediate bar 124 but which is geometrically similar, so that the abrasion portion 609 has a comb-like configuration in the longitudinal direction with projecting regions 612 formed in the region of the scraper knives 115 and is staggered in the tunneling direction with respect to recessed regions 615 set back in the tunneling direction. The recessed regions 615 are advantageously connected with the frame structure 203 at the front side.

For mechanical stabilization of the abrasion portions 609, abutment stands 618 are attached to the frame structure 203, which lie opposite the scraper knives 115, against which the undersides of the abrasion portions 609 facing away from the scraper knives 115 abut, and which slightly protrude with their front side arranged at the front in the tunneling direction opposite the corresponding front side of the abrasion portions 609 for reliable protection.

Figure 7:
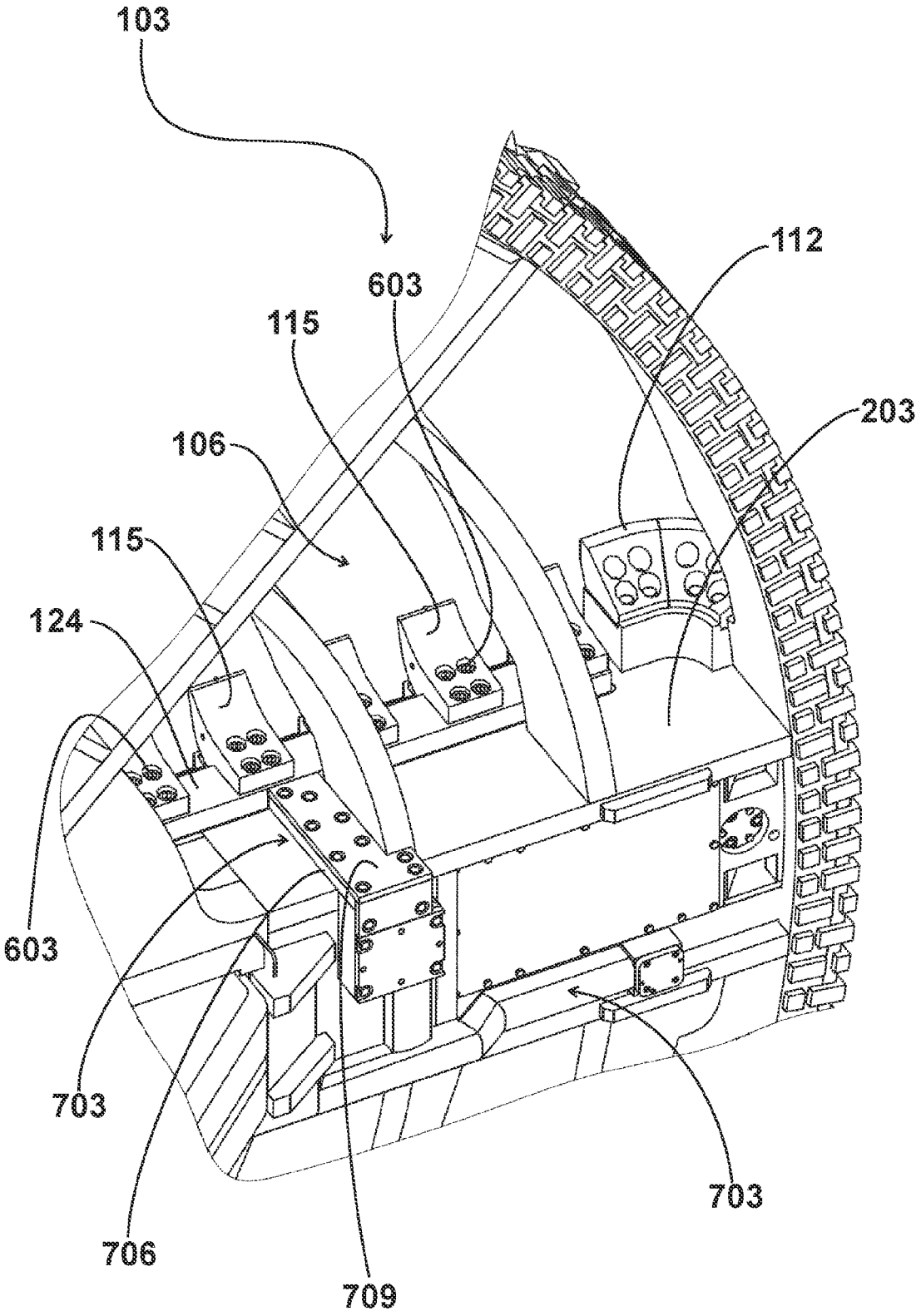
FIG. 7 shows a perspective view of a detail from the exemplary embodiment of a cutting wheel according to FIG. 1 in the region of scraper knives in a view to the rear side arranged at the rear in the tunneling direction.

FIG. 7 shows a perspective view of the arrangement according to FIG. 6 with a view of the rear region of the cutting arm 106 in the tunneling direction. It can be seen from FIG. 7 that on the rearward rear side of the intermediate bar 124 in the tunneling direction there is a multi-component cable duct arrangement 703 of the tool condition monitoring device having U-shaped base parts 706 and flat cover parts 709, which rests against the intermediate bar 124 and extends at an angle along the frame structure 203 of the cutting arm 106 to the rearward side of the frame structure 203 in the tunneling direction. In the cable duct arrangement 703, as explained in more detail below, electrically conductive circuit cables 515, not visible in FIG. 7, are arranged as electrically conductive current conductor elements protected from external mechanical influences.

Figure 8:
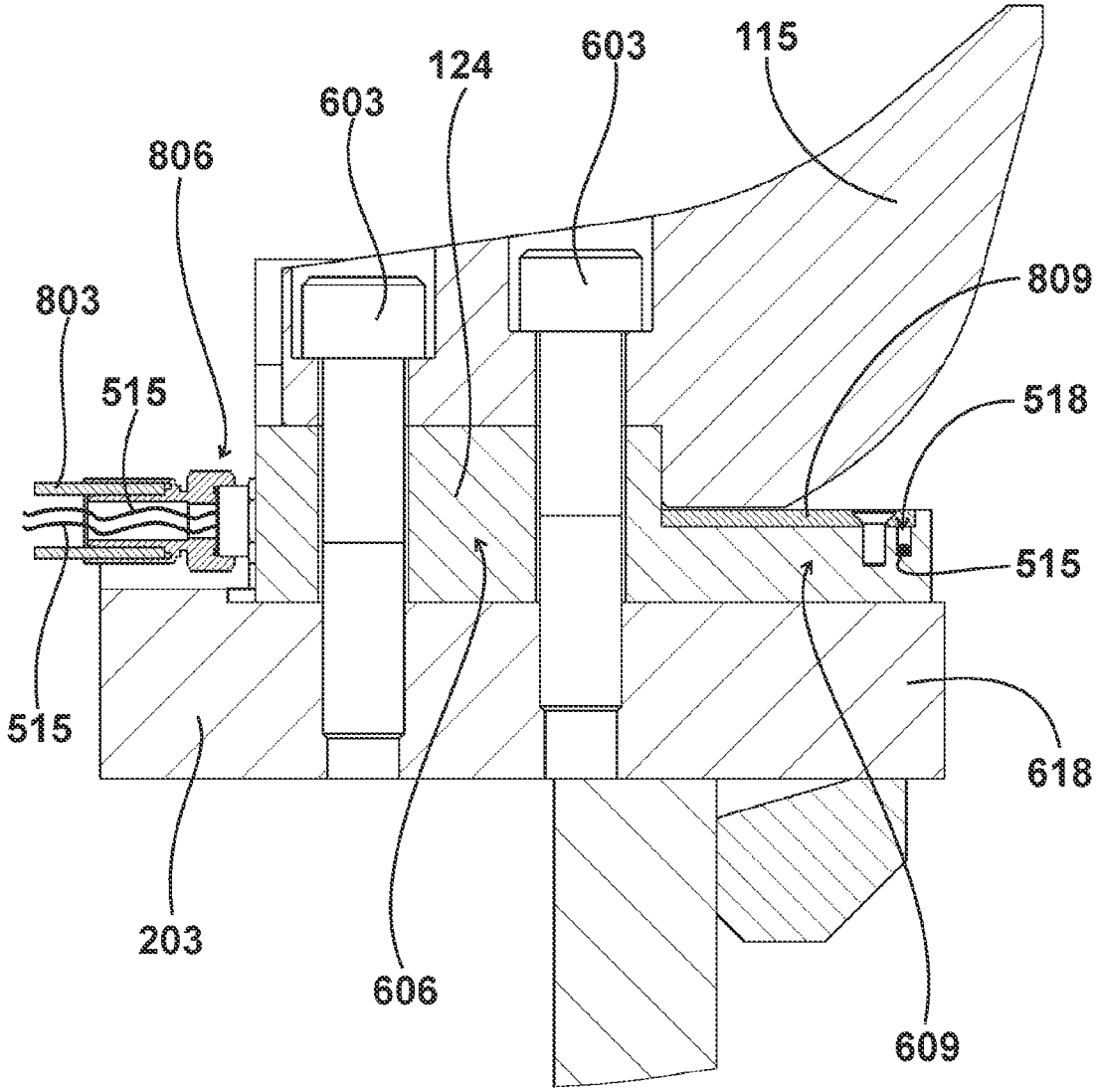
FIG. 8 shows a sectional view of the arrangement according to FIGS. 6 and 7, with a scraper knife and with an intermediate part of a tool condition monitoring device, which intermediate part is installed with the scraper knives on a support plate.

FIG. 8 shows a sectional view of a region of the arrangement according to FIG. 6 and FIG. 7 with the sectional plane passing through a scraper knife 115. From FIG. 8 it can be seen that electrically conductive circuit cables 515 are guided via a cable tube 803 and via a cable entry 806 of the tool condition monitoring device into the intermediate bar 124 and run within the cable groove 518, which extends, among other things, in the front region of the respective abrasion portion 609 in the tunneling direction, wherein the cable groove 518 is recessed in an abrasion portion 609 relative to the front side lying at the front in the tunneling direction when used as intended. Furthermore, it can be seen from the illustration according to FIG. 8 that the abrasion portion 609 is removably closed by a closure cover 809 via screw connections on its side facing the scraper knives 115 when used as intended, so that the cable groove 518 is covered.

By arranging the abrasion portions 609 of the intermediate bars 124 in a recessed way with respect to the front side of a scraper knife 115, which is at the front in the forward direction, the abrasion portions 609 remain protected by the protruding regions of the scraper knives 115 and by the abutment bases 618 in both directions of rotation of the cutting wheel 103 until after a scraper knife 115 has fallen under a predetermined wear limit the corresponding abrasion portion 609 is subject to pronounced wear and finally the circuit cable 515 is interrupted in a certain region. As stated in connection with the explanations above, the interruption of the corresponding electrical circuit can be detected.

In this case, too, due to appropriate dimensioning of the extension of the abrasion portions 609, in particular of their extension in the tunneling direction and of the position of the cable groove 518, an adaptation to a predetermined wear limit for mining tools such as the scraper knives 115 can be set. The intermediate bar 124 can also be replaced relatively easily with the scraper knives 115 in case of maintenance, or groups of scraper knives 115 can be retrofitted by installing intermediate bars 124 to monitor their state of wear.

Figure 9:
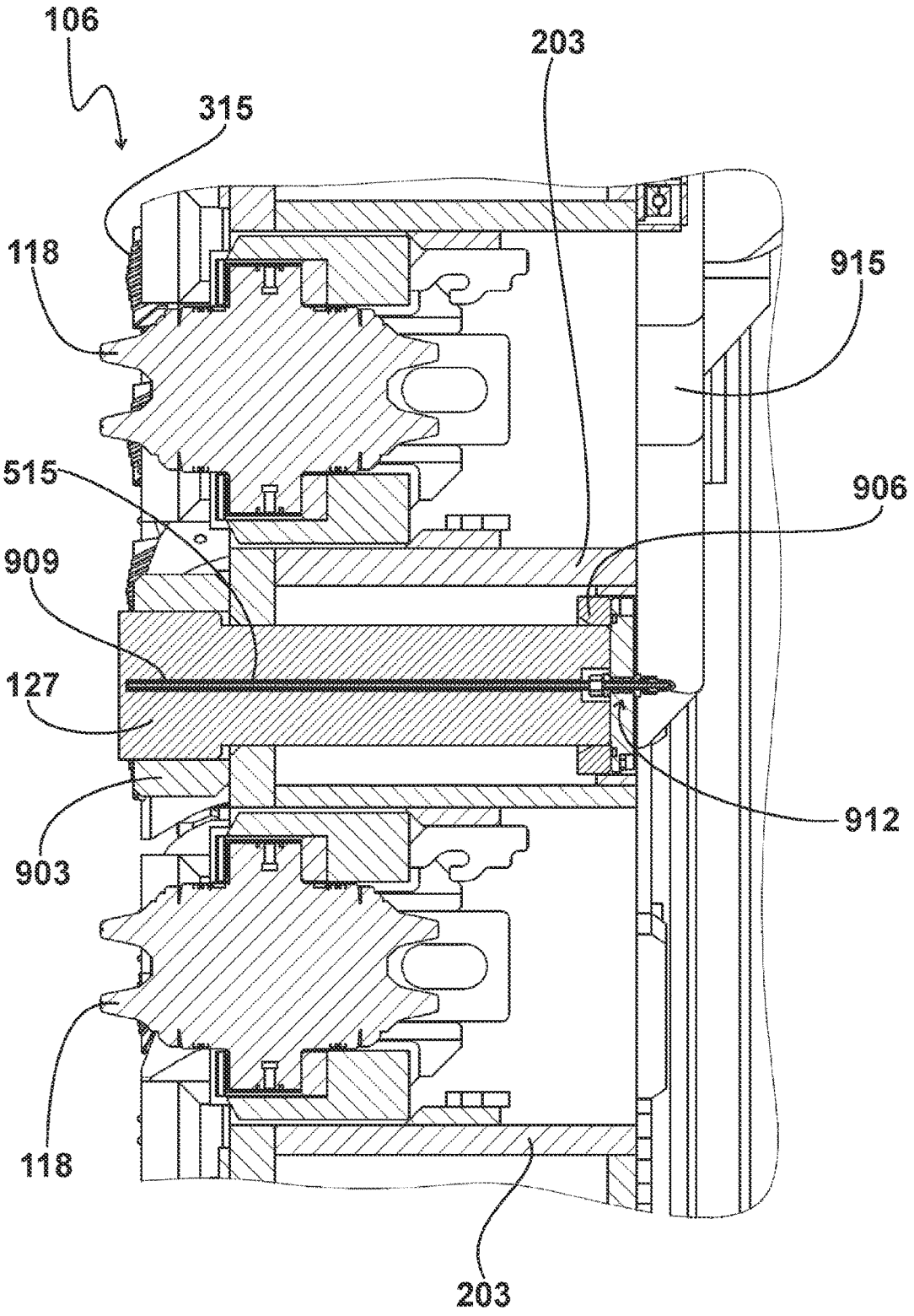
FIG. 9 shows a sectional view of two cutting rollers as a further example of a group of mining tools of the exemplary embodiment of the cutting wheel according to FIG. 1 with an intermediate support bolt of a tool condition monitoring device.

FIG. 9 shows in a sectional view as a further exemplary embodiment of a support part, a support bolt 127 which is arranged between two cutting rollers 118 as embodiments of mining tools. The support bolt 127 is essentially cylindrical and is removably fixedly connected to the frame structure 203 of the corresponding cutting arm 106 by means of a front bracket 903 arranged at the front in the tunneling direction and a foot bracket 906 16 arranged at the rear in the tunneling direction.

The support bolt 127 has a blind hole-like blind hole recess 909 that is closed at one end and is open in the region of a foot region of the support bolt 127 that is fixed by the foot bracket 906 and ends at an abrasion distance from the front side of the support bolt 127, which front side is at the front in the tunneling direction, when used as intended.

An electrically conductive circuit cable 515 is arranged, as an embodiment of a circuit element, in the blind hole recess 909, which extends into the front region of the blind hole recess 909 in the tunneling direction and exits in the opposite foot region of the support bolt 127 via a cable gland 912 and extends in a cable duct 915 of the tool condition monitoring device, which is attached to the rear side of the frame structure 203 of the cutting arm 106 in the tunneling direction.

From FIG. 9 it is evident that the front side of the support bolt 127 in the tunneling direction is recessed with respect to the corresponding front side of unused cutting rollers 118 against the tunneling direction, so that, in accordance with the above explanations in connection with the rakers 112 and scraper knives 115, with increasing wear of the cutting rollers 118 at a characteristic wear limit, the material of the support bolt 127 that is at the front in the tunneling direction is also removed and after the exposure of the blind hole recess 909 in the front region of the support bolt 127, the electrical current conduction in the correspondingly wired circuit cable 515 is also interrupted. This is indicative of reaching a predetermined wear limit, so that corresponding maintenance measures can then be initiated in due time.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

The invention claimed is:

1. A cutting wheel for a tunnel boring machine with a number of mining tools (112, 115, 118) for removal of an upcoming geology structure present, during tunneling, at the cutting wheel (103) in a tunneling direction, and with a tool condition monitoring device for monitoring the state of wear of mining tools (112, 115, 118), wherein the tool condition monitoring device has at least one support part (121, 124, 127) assigned to a mining tool (112, 115, 118) and/or a group of mining tools (112, 115, 118), which support part is connected, removably and at a spatial distance from the one or any one of the mining tools (112, 115, 118) or the one or any one of the groups of mining tools (112, 115, 118), to a frame structure (203), and wherein, in the or each support part (121, 124, 127), at least one electrically conductive current conductor element (515) is embedded in such a way that after an abrasion of the one or of any support part (121, 124, 127) that is characteristic of a predetermined state of wear of the one or of any one of the mining tools (112, 115, 118) and/or of the one or any one of the groups of mining tools (112, 115, 118), the or a current conductor element (515) can be interrupted, wherein the or a support part is designed as an intermediate part (121, 124) which is located between a mining tool (112, 115) and/or a group of mining tools (112, 115) and the frame structure (203), and wherein the intermediate part (121, 124) follows a geometrically similar contour of the front side, in the tunneling direction, of a corresponding mining tool (112, 115) or of a corresponding group of mining tools (112, 115), and wherein the front side in the tunneling direction of the intermediate part (121, 124) is recessed with respect to the contour of the respective front side of the corresponding mining tool (112, 115) and/or of the group of mining tools (112, 115) against the tunneling direction, and wherein the intermediate part (121, 124) has, at a distance from the front side, a cable-receiving recess (518), which extends, in the tunneling direction, on the rear side of an outer material wall (521) of the intermediate part (121) and in which the current-conductor element (515) is arranged.

2. The cutting wheel according claim 1, wherein the current-conductor element (515) is arranged at a distance from the front side of the or a support part (121, 124, 127) which is at the front side in the tunneling direction.

3. The cutting wheel of claim 1, wherein the or a current conductor element is an insulated current conductor cable (515).

4. The cutting wheel of claim 1, wherein the support part (121, 124, 127) is connected to a line guide arrangement of the tool condition monitoring device, which guide is removably connected to the frame structure (203).

5. The cutting wheel according to claim 4, wherein the at least one current conductor element is arranged in the line guide arrangement for protection against external mechanical influences.

6. The cutting wheel according to claim 4, wherein the line guide arrangement comprises pipe connections (206) connected to and ending at a line connection box (209) on its side facing away from a support part (121, 124, 127).

7. The cutting wheel according to claim 6, wherein the line connection box (209) is connected via a line tube (212) to an interconnection box (215), in which a removable plug connection (221) of the tool condition monitoring device is located, and in that the interconnection box (215) is connected to a data transmission unit.

8. A cutting wheel for a tunnel boring machine with a number of mining tools (112, 115, 118) for removal of an upcoming geology structure present, during tunneling, at the cutting wheel (103) in a tunneling direction, and with a tool condition monitoring device for monitoring the state of wear of mining tools (112, 115, 118), wherein the tool condition monitoring device has at least one support part (121, 124, 127) assigned to a mining tool (112, 115, 118) and/or a group of mining tools (112, 115, 118), which support part is connected, removably and at a spatial distance from the one or any one of the mining tools (112, 115, 118) or the one or any one of the groups of mining tools (112, 115, 118), to a frame structure (203), and wherein in the or each support part (121, 124, 127) at least one electrically conductive current conductor element (515) is embedded, and wherein the electrically conductive current conductor element (515) is embedded in such a way that after an abrasion of the one or of any support part (121, 124, 127) that is characteristic of a predetermined state of wear of the one or of any one of the mining tools (112, 115, 118) and/or of the one or any one of the groups of mining tools (112, 115, 118), the or a current conductor element (515) can be interrupted, and in that the or a support part is designed as an elongate support bolt (127) which is arranged at a lateral distance from at least one mining tool (118).

9. The cutting wheel according to claim 8, wherein the front side of the support bolt (127), which is arranged at the front in the tunneling direction, is recessed, with respect to the tunneling direction, relative to the front side of an adjacent mining tool (118) which is at the front in the tunneling direction.

10. The cutting wheel according to claim 8, wherein the support bolt (127) has a blind hole recess (909) which extends in the longitudinal direction and in which the current conductor element (515) is arranged.

11. The cutting wheel according to claim 8, wherein the current conductor element (515) terminates at a distance from the front side of the support bolt (127).

12. The cutting wheel according claim 8, wherein the current-conductor element (515) is arranged at a distance from the front side of the or a support part (121, 124, 127) which is at the front side in the tunneling direction.

13. The cutting wheel of claim 8, wherein the or a current conductor element is an insulated current conductor cable (515).

14. The cutting wheel of claim 8, wherein the support part (121, 124, 127) is connected to a line guide arrangement of the tool condition monitoring device, which guide is removably connected to the frame structure (203).

15. The cutting wheel according to claim 14, wherein the at least one current conductor element is arranged in the line guide arrangement for protection against external mechanical influences.

16. The cutting wheel according to claim 14, wherein the line guide arrangement comprises pipe connections (206) connected to and ending at a line connection box (209) on its side facing away from a support part (121, 124, 127).

17. The cutting wheel according to claim 16, wherein the line connection box (209) is connected via a line tube (212) to an interconnection box (215), in which a removable plug connection (221) of the tool condition monitoring device is located, and in that the interconnection box (215) is connected to a data transmission unit.

* * * * *